US010621923B2

(12) United States Patent
Wang

(10) Patent No.: US 10,621,923 B2
(45) Date of Patent: Apr. 14, 2020

(54) SCANNING DRIVE SYSTEM OF AMOLED DISPLAY PANEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Limin Wang, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 274 days.

(21) Appl. No.: 15/736,565

(22) PCT Filed: Nov. 25, 2017

(86) PCT No.: PCT/CN2017/112972
§ 371 (c)(1),
(2) Date: Dec. 14, 2017

(87) PCT Pub. No.: WO2019/061784
PCT Pub. Date: Apr. 4, 2019

(65) Prior Publication Data

US 2019/0385537 A1 Dec. 19, 2019

(30) Foreign Application Priority Data

Sep. 29, 2017 (CN) ..... 2017 1 0911808

(51) Int. Cl.
*G09G 3/3291* (2016.01)
*G09G 3/3266* (2016.01)
*G09G 3/3258* (2016.01)

(52) U.S. Cl.
CPC ..... *G09G 3/3291* (2013.01); *G09G 3/3258* (2013.01); *G09G 3/3266* (2013.01)

(58) Field of Classification Search
CPC .. G09G 3/3291; G09G 3/3258; G09G 3/3266; G09G 3/3233; H03K 17/56; G11C 19/00
See application file for complete search history.

(56) References Cited

U.S. PATENT DOCUMENTS 9,564,889 B2 * 2/2017 Lin ..... G09G 3/3266
10,192,512 B2 * 1/2019 Koide ..... G09G 3/3677
(Continued)

FOREIGN PATENT DOCUMENTS

CN 103745685 4/2014
CN 104505038 4/2015
(Continued)

*Primary Examiner* — Sardis F Azongha
(74) *Attorney, Agent, or Firm* — Hemisphere Law, PLLC; Zhigang Ma

(57) ABSTRACT

A scanning drive system of AMOLED display panel is provided. The scanning drive system of AMOLED display panel of this disclosure comprises a gate drive circuit, a scanning signal selection circuit and a pixel drive circuit. The scanning signal outputted to the scanning signal selection circuit by gate drive circuit. The scanning signal selection circuit controls the first output terminal and the second output terminal simultaneously output the low-potential signal, scanning signal, or respectively output the low-potential signal and the scanning signal, or respectively output the scanning signal and the low-potential signal to the pixel drive circuit according to the first control signal and the second control signal. It could simultaneously achieve internal compensation and reduces requirement of output channel number of gate drive circuit, and enhances flexibility control a scanning signal selection circuit.

12 Claims, 6 Drawing Sheets

(56) References Cited

U.S. PATENT DOCUMENTS

| | | | | |
|---|---|---|---|---|
| 10,403,204 | B2 * | 9/2019 | Miyake | G09G 3/36 |
| 2014/0160185 | A1 * | 6/2014 | Okuno | G09G 3/3233<br>345/691 |
| 2015/0279279 | A1 * | 10/2015 | Toyomura | G09G 3/3233<br>345/212 |
| 2016/0027411 | A1 * | 1/2016 | Lin | G09G 3/20<br>345/212 |
| 2017/0039930 | A1 * | 2/2017 | Li | G09G 3/20 |

FOREIGN PATENT DOCUMENTS

| | | |
|---|---|---|
| CN | 104536627 | 4/2015 |
| CN | 104808862 | 7/2015 |
| CN | 105321479 | 2/2016 |
| CN | 105976780 | 9/2016 |

* cited by examiner

SCANNING DRIVE SYSTEM OF AMOLED DISPLAY PANEL

RELATED APPLICATIONS

The present application is a National Phase of International Application Number PCT/CN2017/112972, filed on Nov. 25, 2017, and claims the priority of China Application 201710911808.9, filed Sep. 29, 2017.

FIELD OF THE DISCLOSURE

The disclosure relates to a display technical field, and more particularly to a scanning drive system of AMOLED display panel.

BACKGROUND

The Organic Light Emitting Display (OLEO) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving ways, which are the Passive Matrix OLED (PMOLED) and the Active Matrix OLED (AMOLED), i.e. two types of the direct addressing and the Thin Film Transistor matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmits voltage signals. Therefore, the AMOLED pixel driving circuit needs to accomplish the task of converting the voltage signals into the current signals. Usually, there has a drive TFT for driving OLED to emitting in AMOLED pixel drive circuit. In use, because of aging of OLED and shift of a threshold voltage of the driving TFT, which causes the display quality of OLED display device be decreased so that needs to detect threshold voltage of drive TFT in using and compensates it for ensure the display quality of OLED display device.

Compensation technology of AMOLED can be categorized into two major types of internal compensation and external compensation, most of all needs more TFT to achieve compensation. Therefore, it needs more scanning drive signal, especially for the internal compensation, and design of the gate drive circuit play a key factor for that. More complicated internal compensation more scanning signal be needed, and a huge number of scanning signals let Drive IC and panel circuit design bring a serious problem, and increase cost of panel.

SUMMARY

A technical problem to be solved by the disclosure is to provide a scanning drive system of AMOLED display panel which could simultaneously achieves internal compensation and reduces requirement of output channel number of gate drive circuit.

An objective of the disclosure is achieved by following embodiments. In particular, a scanning drive system of AMOLED display panel comprises a gate drive circuit, a scanning signal selection circuit, and a pixel drive circuit.

The scanning signal selection circuit comprises a first input terminal, a second input terminal, a first control terminal, a second control terminal, a first output terminal and a second output terminal; the first input terminal of the scanning signal selection circuit is electrically coupled with the gate drive circuit, the second input terminal access a low-potential signal, the first control terminal and the second control terminal respectively access a first control signal and a second control signal, the first output terminal and the second output terminal are both electrically coupled with the pixel drive circuit.

The gate drive circuit outputs a scanning signal to the first input terminal of the scanning signal selection circuit.

The scanning signal selection circuit controls the first output terminal and the second output terminal simultaneously output the low-potential signals, or simultaneously output the scanning signals, or respectively output the low-potential signal and the scanning signal, or respectively output the scanning signal and the low-potential signal to the pixel drive circuit according to the first control signal and the second control signal.

In an embodiment, when both of the first control signal and the second control signal are low-potential, the first output terminal and the second output terminal simultaneously output the low-potential signals to the pixel drive circuit.

When both of the first control signal and the second control signal are high-potential, the first output terminal and the second output terminal simultaneously output the scanning signals to the pixel drive circuit.

When the first control signal is low-potential and the second control signal is high-potential, the first output terminal and the second output terminal respectively output the low-potential signal and the scanning signal to the pixel drive circuit.

When the first control signal is high-potential and the second control signal is low-potential, the first output terminal and the second output terminal respectively output the scanning signal and the low-potential signal to the pixel drive circuit.

In an embodiment, the scanning signal selection circuit comprises a first TFT, a second TFT, a third TFT, a fourth TFT, a first inverter and a second inverter.

A gate of the first TFT is electrically coupled with an output terminal of the first inverter, and a source of the first TFT access the low-potential signal, a drain of the first TFT is electrically coupled with a drain of the second TFT.

A gate of the second TFT is electrically coupled with an input terminal of the first inverter, and a source of the second TFT access the scanning signal.

A gate of the third TFT is electrically coupled with an input terminal of the second inverter, and a source of the third TFT is electrically coupled with a source of the second TFT, a drain of the third TFT is electrically coupled with a drain of the fourth TFT.

A gate of the fourth TFT is electrically coupled with an output terminal of the second inverter, and a source of the fourth TFT access the low-potential signal.

An Input terminal of the first inverter and an input terminal of the second inverter are respectively access the first control signal and the second control signal.

In an embodiment, the pixel drive circuit comprises a fifth TFT, a sixth TFT, a seventh TFT, a eighth TFT, a ninth TFT, a capacitance and an OLED.

A gate of the fifth TFT is electrically coupled with the first output terminal of the scanning signal selection circuit, and a source of the fifth TFT access a maintaining voltage, a drain of the fifth TFT is electrically coupled with a first terminal of the capacitance.

A gate of the sixth TFT is electrically coupled with the second output terminal of the scanning signal selection circuit, and a source of the sixth TFT access a data signal, a drain of the sixth TFT is electrically coupled with a first terminal of the capacitance.

A gate of the seventh TFT is electrically coupled with the second output terminal of the scanning signal selection circuit, and a source of the seventh TFT is electrically coupled with a source of the eighth TFT, a drain of the seventh TFT is electrically coupled with a gate of the ninth TFT.

A gate of the eighth TFT is electrically coupled with the first output terminal of the scanning signal selection circuit, and a drain of the eighth TFT access power high voltage.

A drain of the ninth TFT is electrically coupled with the source of the eighth TFT, and a source of the ninth TFT is electrically coupled with an anode of the OLED.

A second terminal of the capacitance is electrically coupled with the gate of the ninth TFT.

A cathode terminal of the capacitance access a power negative voltage.

In an embodiment, working processes of the pixel drive circuit sequentially comprises a data signal writing phase, a threshold voltage compensation phase and a light-emitting phase.

The first output terminal of the scanning signal selection circuit outputs the low-potential signal, and the second output terminal outputs the scanning signal in the data signal writing phase.

The first output terminal and the second output terminal of the scanning signal selection circuit both output the scanning signals in the threshold voltage compensation phase.

The first output terminal of the scanning signal selection circuit outputs the scanning signal, and the second output terminal outputs the low-potential signal in the light-emitting phase.

In an embodiment, the AMOLED display panel comprises a display region and a non-display region surroundings to the display region, the pixel drive circuit is positioned in the display region, and the scanning signal selection circuit is positioned in the non-display region.

In an embodiment, the gate drive circuit is a GOA circuit formed in the non-display region or an integrated circuit integrated circuit external to the non-display region.

In an embodiment, the first control signal and the second control signal are both provided by an outside time schedule controller.

According to another aspect of the disclosure, the disclosure further provides a scanning drive system of AMOLED display panel. The canning drive system of AMOLED display panel includes a gate drive circuit, a scanning signal selection circuit, and a pixel drive circuit.

The scanning signal selection circuit comprises a first input terminal, a second input terminal, a first control terminal, a second control terminal, a first output terminal and a second output terminal; the first input terminal of the scanning signal selection circuit is electrically coupled with the gate drive circuit, the second input terminal access a low-potential signal, the first control terminal and the second control terminal respectively access a first control signal and a second control signal, the first output terminal and the second output terminal are both electrically coupled with the pixel drive circuit.

The gate drive circuit outputs a scanning signal to the first input terminal of the scanning signal selection circuit.

The scanning signal selection circuit controls the first output terminal and the second output terminal simultaneously output the low-potential signals, or simultaneously output the scanning signals, or respectively output the low-potential signal and the scanning signal, or respectively output the scanning signal and the low-potential signal to the pixel drive circuit according to the first control signal and the second control signal.

When both of the first control signal and the second control signal are low-potential, the first output terminal and the second output terminal simultaneously output the low-potential signals to the pixel drive circuit.

When both of the first control signal and the second control signal are high-potential, the first output terminal and the second output terminal simultaneously output the scanning signals to the pixel drive circuit.

When the first control signal is low-potential and the second control signal is high-potential, the first output terminal and the second output terminal respectively output the low-potential signal and the scanning signal to the pixel drive circuit.

When the first control signal is high-potential and the second control signal is low-potential, the first output terminal and the second output terminal respectively output the scanning signal and the low-potential signal to the pixel drive circuit.

The scanning signal selection circuit comprises a first TFT, a second TFT, a third TFT, a fourth TFT, a first inverter and a second inverter.

A gate of the first TFT is electrically coupled with an output terminal of the first inverter, and a source of the first TFT access the low-potential signal, a drain of the first TFT is electrically coupled with a drain of the second TFT.

A gate of the second TFT is electrically coupled with an input terminal of the first inverter, and a source of the second TFT access the scanning signal.

A gate of the third TFT is electrically coupled with an input terminal of the second inverter, and a source of the third TFT is electrically coupled with a source of the second TFT, a drain of the third TFT is electrically coupled with a drain of the fourth TFT.

A gate of the fourth TFT is electrically coupled with an output terminal of the second inverter, and a source of the fourth TFT access the low-potential signal.

An Input terminal of the first inverter and an input terminal of the second inverter are respectively access the first control signal and the second control signal. The pixel drive circuit comprises a fifth TFT, a sixth TFT, a seventh TFT, a eighth TFT, a ninth TFT, a capacitance and an OLED.

A gate of the fifth TFT is electrically coupled with the first output terminal of the scanning signal selection circuit, and a source of the fifth TFT access a maintaining voltage, a drain of the fifth TFT is electrically coupled with a first terminal of the capacitance.

A gate of the sixth TFT is electrically coupled with the second output terminal of the scanning signal selection circuit, and a source of the sixth TFT access a data signal, a drain of the sixth TFT is electrically coupled with a first terminal of the capacitance.

A gate of the seventh TFT is electrically coupled with the second output terminal of the scanning signal selection circuit, and a source of the seventh TFT is electrically coupled with a source of the eighth TFT, a drain of the seventh TFT is electrically coupled with a gate of the ninth TFT.

A gate of the eighth TFT is electrically coupled with the first output terminal of the scanning signal selection circuit, and a drain of the eighth TFT access power high voltage.

A drain of the ninth TFT is electrically coupled with the source of the eighth TFT, and a source of the ninth TFT is electrically coupled with an anode of the OLED.

A second terminal of the capacitance is electrically coupled with the gate of the ninth TFT.

A cathode terminal of the capacitance access a power negative voltage.

Working processes of the pixel drive circuit sequentially comprises a data signal writing phase, a threshold voltage compensation phase and a light-emitting phase.

The first output terminal of the scanning signal selection circuit outputs the low-potential signal, and the second output terminal outputs the scanning signal in the data signal writing phase.

The first output terminal and the second output terminal of the scanning signal selection circuit both output the scanning signals in the threshold voltage compensation phase.

The first output terminal of the scanning signal selection circuit outputs the scanning signal, and the second output terminal outputs the low-potential signal in the light-emitting phase.

In sum, a scanning drive system of AMOLED display panel of this disclosure comprises a gate drive circuit, a scanning signal selection circuit and a pixel drive circuit. The scanning signal selection circuit comprises a first input terminal, a second input terminal, a first control terminal, a second control terminal, a first output terminal and a second output terminal. The first input terminal of the scanning signal selection circuit is electrically coupled with the gate drive circuit. The second input terminal access a low-potential signal. The first control terminal and the second control terminal respectively access a first control signal and a second control signal. The first output terminal and the second output terminal are both electrically coupled with the pixel drive circuit. The scanning signal selection circuit controls the first output terminal and the second output terminal simultaneously output the low-potential signals, or simultaneously output scanning signals, or respectively output the low-potential signal and the scanning signal, or respectively output the scanning signal and the low-potential signal to the pixel drive circuit according to the first control signal and the second control signal. It could simultaneously achieve internal compensation and reduces requirement of output channel number of gate drive circuit, and enhances flexibility control a scanning signal selection circuit.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

The specific structural and functional details disclosed herein are only representative and are intended for describing exemplary embodiments of the disclosure. However, the disclosure can be embodied in many forms of substitution, and should not be interpreted as merely limited to the embodiments described herein.

The disclosure will be further described in detail with reference to accompanying drawings and preferred embodiments as follows.

Figure 1:
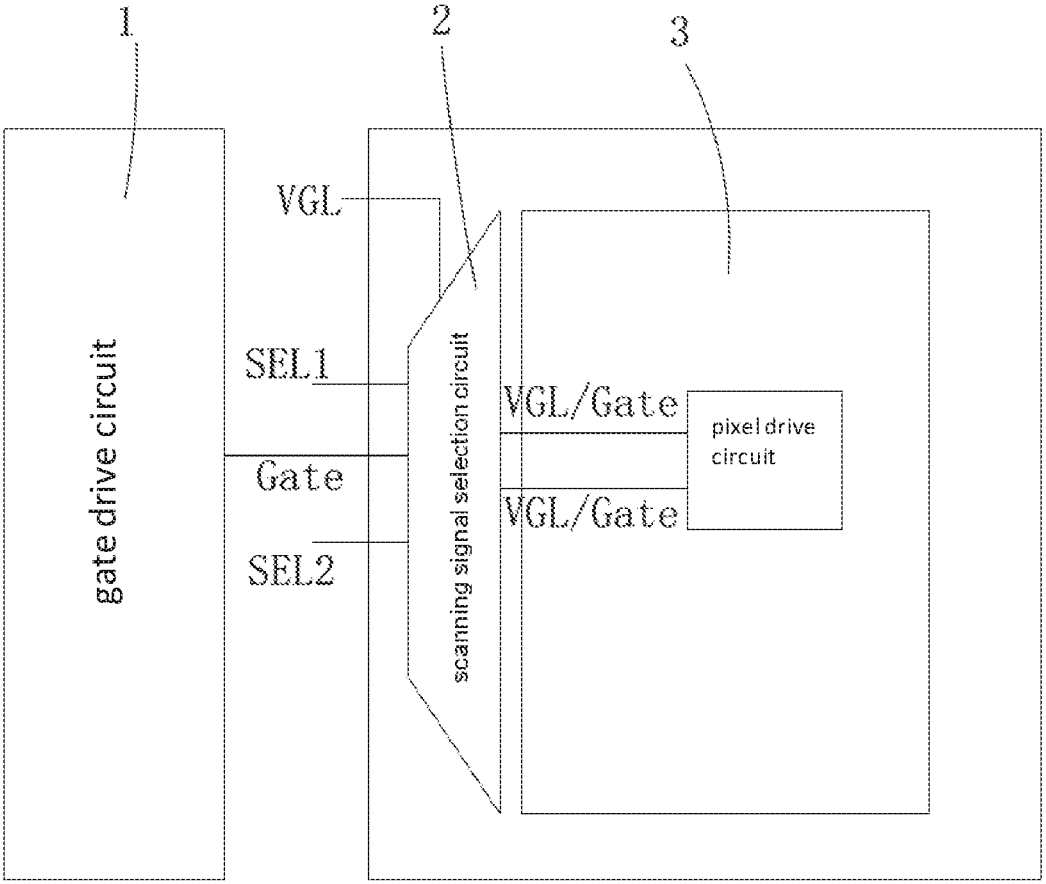
FIG. 1 is a module diagram of the scanning drive system of AMOLED display panel according to an embodiment of the disclosure.

Please refer to FIG. 1. The scanning drive system of AMOLED display panel is provided. The scanning drive system of AMOLED display panel comprises a gate drive circuit 1, a scanning signal selection circuit 2 and a pixel drive circuit 3.

The scanning signal selection circuit 2 comprises a first input terminal, a second input terminal, a first control terminal, a second control terminal, a first output terminal and a second output terminal. The first input terminal of the scanning signal selection circuit 2 is electrically coupled with the gate drive circuit 1, the second input terminal access low-potential signal VGL, the first control terminal and the second control terminal respectively access first control signal SEL1 and second control signal SEL2, the first output terminal and the second output terminal are both electrically coupled with the pixel drive circuit 3.

The gate drive circuit 1 outputs a scanning signal Gate to the first input terminal of the scanning signal selection circuit 2.

The scanning signal selection circuit 2 controls the first output terminal and the second output terminal simultaneously output the low-potential signals VGL, or simultaneously output the scanning signals Gate, or respectively output the low-potential signal VGL and the scanning signal Gate, or respectively output the scanning signal Gate and the low-potential signal VGL to the pixel drive circuit 3 according to the first control signal SEL1 and the second control signal SEL2.

Specifically, when both of the first control signal SEL1 and the second control signal SEL2 both are low-potential, the first output terminal and the second output terminal simultaneously output low-potential signals VGL to the pixel drive circuit 3. When both of the first control signal SEL1 and the second control signal SEL2 are high-potential, the first output terminal and the second output terminal simultaneously output scanning signals Gate to the pixel drive circuit 3. When the first control signal SEL1 is low-potential and the second control signal SEL2 is high-potential, the first output terminal and the second output terminal respectively output the low-potential signal VGL and the scanning signal Gate to the pixel drive circuit 3. When the first control signal SEL 1 is high-potential and the second control signal SEL2 is low-potential, the first output terminal and the second output terminal respectively output the scanning signal Gate and the low-potential signal VGL to the pixel drive circuit 3.

Figure 2:
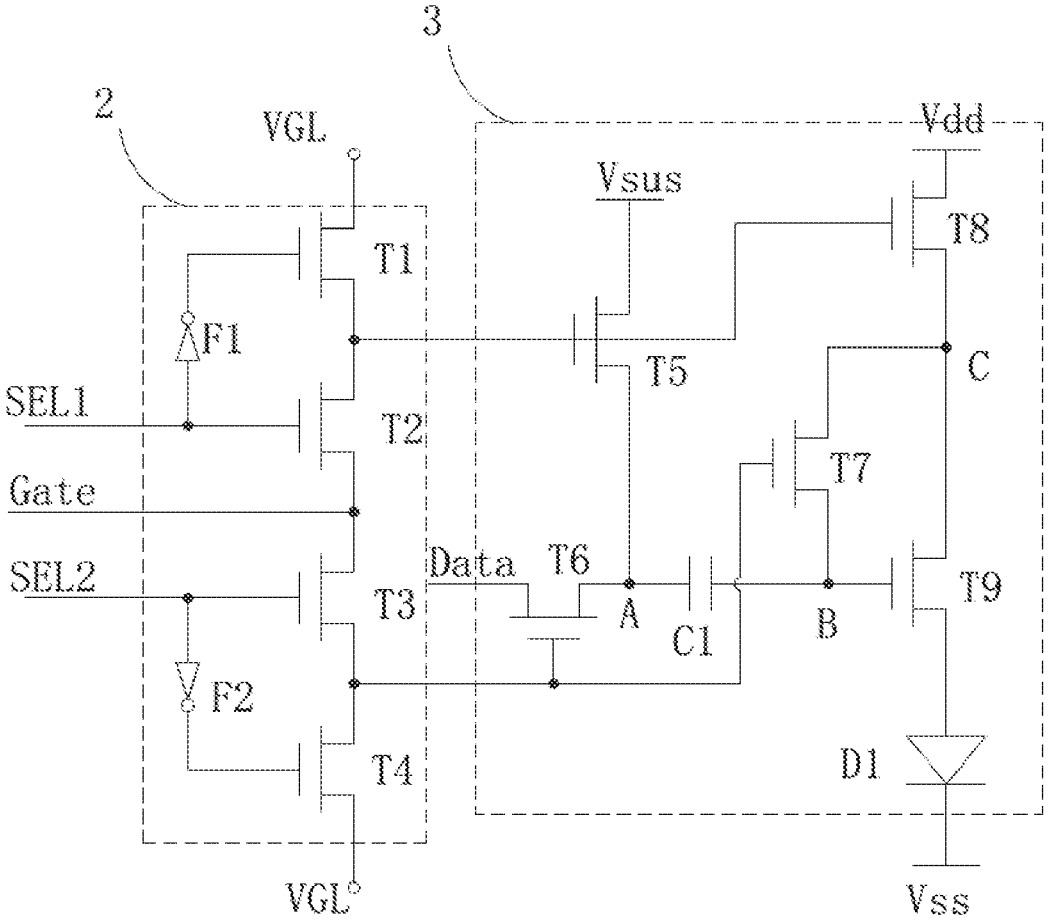
FIG. 2 is a circuit schematic view of a scanning signal selection circuit and a pixel drive circuit of the scanning drive system of AMOLED display panel according to an embodiment of the disclosure.

Preferably, in the embodiment of the present invention, please refer to FIG. 2. The scanning signal selection circuit 2 comprises a first TFT T1, a second TFT T2, a third TFT T3, a fourth TFT T4, a first inverter F1 and a second inverter F2.

A gate of the first TFT T1 is electrically coupled with an output terminal of the first inverter F1, and a source of the first TFT T1 access the low-potential signal VGL, a drain of the first TFT T1 is electrically coupled with a drain of the second TFT T2. A gate of the second TFT T2 is electrically coupled with an input terminal of the first inverter F1, and a source of the second TFT T2 access the scanning signal Gate. A gate of the third TFT T3 is electrically coupled with an input terminal of the second inverter F2, and a source of the third TFT T3 is electrically coupled with a source of the second TFT T2, a drain of the third TFT T3 is electrically coupled with a drain of the fourth TFT T4. A gate of the fourth TFT T4 is electrically coupled with an output terminal of the second inverter F2, and a source of the fourth TFT T4 access the low-potential signal VGL. An input terminal of the first inverter F1 and an input terminal of the second inverter F2 are respectively access the first control signal SEL1 and the second control signal SEL2. The first TFT T1, the second TFT T2, the third TFT T3 and the fourth TFT T4 are N-type TFT.

It should be noted that, specifically embodiment of the scanning signal selection circuit 2 is not be limited to structure circuit described above, there could have other embodiments for structure circuit of the scanning signal selection circuit 2. For example, in other embodiment of the present invention. It could removed the first inverter F1 and the second inverter F2 in the above embodiment, and also the second TFT T2, the third TFT T3 are N-type TFT and the first TFT T1, the fourth TFT T4 are P-type TFT. So that it could also achieve to the function of scanning signal selection circuit 2 in the present invention, it is not limited thereto.

Specifically, please refer to FIG. 2. In the embodiment of the present invention, the pixel drive circuit 3 comprises a fifth TFT T5, a sixth TFT T6, a seventh TFT T7, a eighth TFT T8, a ninth TFT T9, a capacitance C1 and an OLED D1.

Wherein a gate of the fifth TFT T5 is electrically coupled with the first output terminal of the scanning signal selection circuit 2, and a source of the fifth TFT T5 access maintaining voltage Vsus, a drain of the fifth TFT T5 is electrically coupled with a first terminal of the capacitance C1. A gate of the sixth TFT T6 is electrically coupled with the second output terminal of the scanning signal selection circuit 2, and a source of the sixth TFT T6 access data signal Data, a drain of the sixth TFT T6 is electrically coupled with a first terminal the capacitance C1. A gate of the seventh TFT T7 is electrically coupled with the second output terminal of the scanning signal selection circuit 2, and a source of the seventh TFT T7 is electrically coupled with a source of the eighth TFT T8, a drain of the seventh TFT T7 is electrically coupled with a gate of the ninth TFT T9. A gate of the eighth TFT T8 is electrically coupled with the first output terminal of the scanning signal selection circuit 2, and a drain of the eighth TFT T8 access power high voltage Vdd. A drain of the ninth TFT T9 is electrically coupled with the source of the eighth TFT T8, and a source of the ninth TFT T9 is electrically coupled with an anode of the OLED. A second terminal of the capacitance C1 is electrically coupled with the gate of the ninth TFT T9. A cathode terminal of the capacitance C1 accesses power negative voltage Vss.

Figure 3:
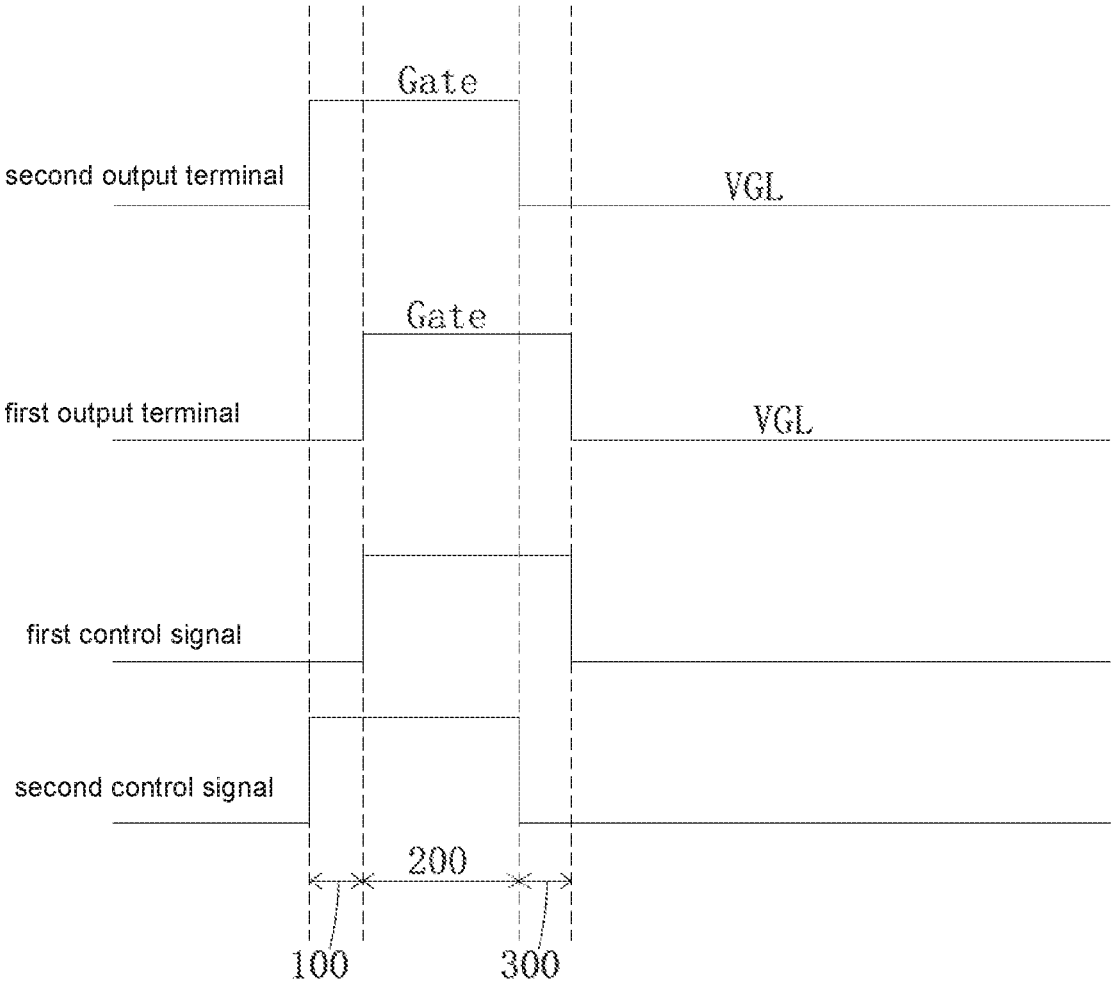
FIG. 3 is a time sequence diagram of the scanning drive system of AMOLED display panel according to an embodiment of the disclosure.

It is noted that, shown as FIG. 3. In the above embodiment, working processes of the pixel drive circuit 3 sequentially comprises a data signal writing phase 100, a threshold voltage compensation phase 200 and a light-emitting phase 300.

Figure 4:
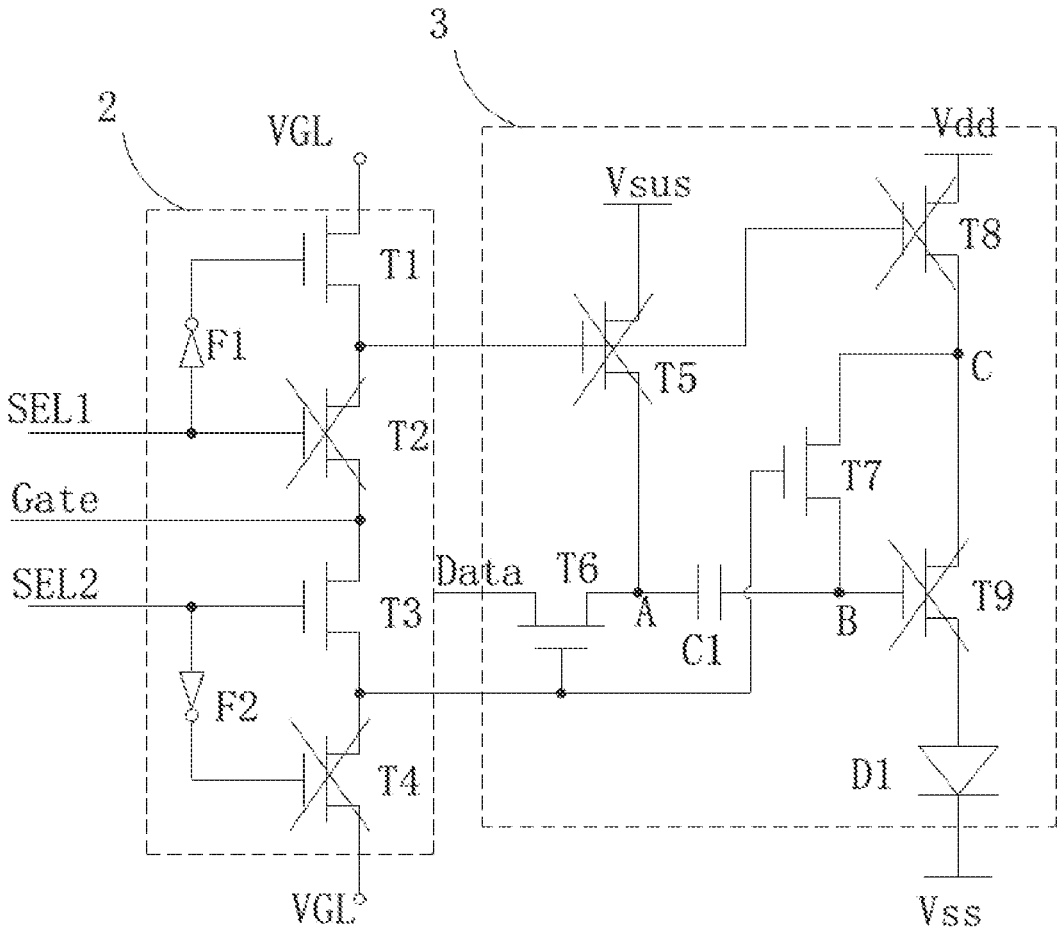
FIG. 4 is a schematic view of a data signal writing phase of the scanning drive system of AMOLED display panel according to an embodiment of the disclosure.

Wherein, please refer to FIG. 4. In the data signal writing phase 100, the first output terminal of the scanning signal selection circuit 2 outputs the low-potential signal VGL, and the second output terminal outputs the scanning signal Gate. Correspondingly, the first control signal SEL1 is low-potential; the second control signal SEL2 is high-potential; the first TFT T1, the third TFT T3, the sixth TFT T6 and the seventh TFT T7 are turn-on; the second TFT T2, the fourth TFT T4, the fifth TFT T5 and the eighth TFT T8 are turn-off. The ninth TFT T9 is short-circuited by the seventh TFT T7 to diode, the first node A writes data signal Data, the second node B changes voltage to VSS+Vth1+Vth2, the VSS is power low voltage, the Vth1 is threshold voltage of ninth TFT T9, Vth2 is threshold voltage of OLED D1.

Figure 5:
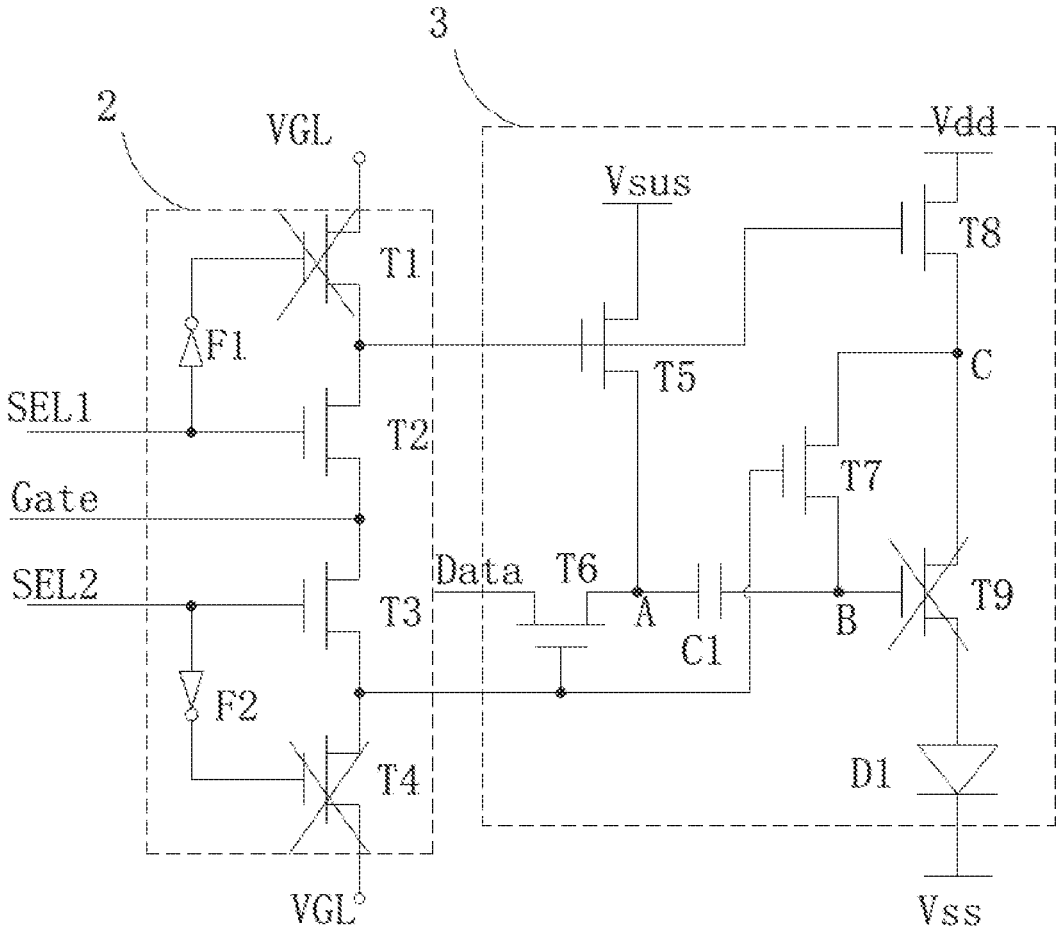
FIG. 5 is a schematic view of a threshold voltage compensation phase of the scanning drive system of AMOLED display panel according to an embodiment of the disclosure.

Please refer to FIG. 5. In the threshold voltage compensation phase 200, the first output terminal and the second output terminal of the scanning signal selection circuit 2 both output the scanning signals Gate. Correspondingly, the first control signal SEL1 is high-potential; the second control signal SEL2 is high-potential; the second TFT T2, the third TFT T3, the fifth TFT T5, the sixth TFT T6, the seventh TFT T7 and the eighth TFT T8 are turn-on; the first TFT T1 and the fourth TFT T4 are turn-off. The ninth TFT T9 is short-circuited by the seventh TFT T7 to diode, the first node A writes maintaining voltage Vsus.

Figure 6:
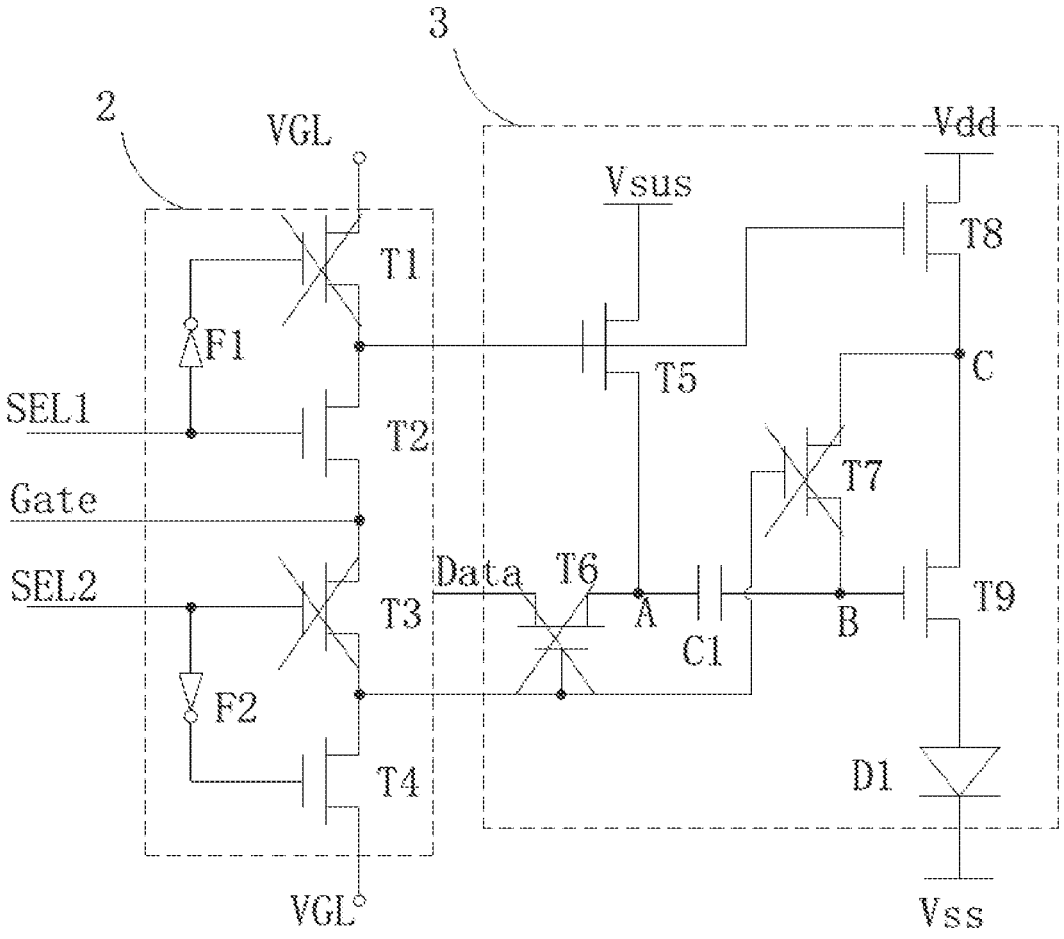
FIG. 6 is a schematic view of a light-emitting phase of the scanning drive system of AMOLED display panel according to an embodiment of the disclosure.

Please refer to FIG. 6. In the light-emitting phase 300, the first output terminal of the scanning signal selection circuit 2 outputs the scanning signal Gate, and the second output terminal outputs the low-potential signal VGL. Correspondingly, the first control signal SEL1 is high-potential; the second control signal SEL2 is low-potential; the second TFT T2, the fourth TFT T4, the fifth TFT T5, the eighth TFT T8 and ninth TFT T9 are turn-on; the first TFT T1, the third TFT T3, the sixth TFT T6, the seventh TFT T7 are turn-off. The ninth TFT T9 is short-circuited by the seventh TFT T7 to diode, the first node A writes maintaining voltage Vsus, the second node B gradually increases the voltage to VSS+Vth1+Vth2+Vsus−Vdata. The Vdata is voltage of data signal, the VSS+Vth2+f(Data) is source voltage of ninth TFT T9, f(Data) indicates a function of data signal Data shows effect of source voltage of the first TFT T1 by data signal Data. Persons of ordinary skill in the art could applied the correspondingly function be known. So that the passing current of OLED D1 is:

$$I=K[VSS+\mathrm{Vth1}+\mathrm{Vth2}+Vsus-\mathrm{Vdata})-(VSS+\mathrm{Vth2}+f(\mathrm{Data}))-\mathrm{Vth1}]2=K[Vsus-\mathrm{VData}-f(\mathrm{Data})]2$$

K is a construction parameter of the drive TFT, which is the ninth TFT T9, comparing with the same structure of TFT, K value is relatively stable. Therefore, the current I which passing the OLED D1 is not related to the threshold voltage of the ninth TFT T9, the threshold voltage of the OLED D1. It achieved the compensation function, efficiency compensates variety threshold voltage for uniform the display brightness of AMOLED, enhance display quality.

Specifically, shown as FIG. 1. The AMOLED display panel includes a display region and a non-display region surroundings to the display region. The pixel drive circuit 3 is positioned in the display region, and the scanning signal selection circuit 2 is positioned in the non-display region. Selectively, the gate drive circuit 1 is a GOA circuit formed in the non-display region or an integrated circuit integrated circuit external to the non-display region.

Specifically, the first control signal SEL1 and the second control signal SEL2 are both provided by an outside time schedule controller.

In sum, a scanning drive system of AMOLED display panel of this disclosure comprises a gate drive circuit, a scanning signal selection circuit and a pixel drive circuit. The scanning signal selection circuit comprises a first input terminal, a second input terminal, a first control terminal, a second control terminal, a first output terminal and a second output terminal. The first input terminal of the scanning signal selection circuit is electrically coupled with the gate drive circuit. The second input terminal access a low-potential signal. The first control terminal and the second control terminal respectively access a first control signal and a second control signal. The first output terminal and the second output terminal are both electrically coupled with the pixel drive circuit. The scanning signal selection circuit controls the first output terminal and the second output terminal simultaneously output the low-potential signals, or simultaneously output scanning signal, or respectively output the low-potential signal and the scanning signal, or respectively output the scanning signal and the low-potential signal to the pixel drive circuit according to the first control signal and the second control signal. It could simultaneously achieve internal compensation and reduces requirement of output channel number of gate drive circuit, and enhances flexibility control a scanning signal selection circuit.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A scanning drive system of AMOLED display panel, comprising a gate drive circuit, a scanning signal selection circuit, and a pixel drive circuit;

the scanning signal selection circuit comprises a first input terminal, a second input terminal, a first control terminal, a second control terminal, a first output terminal and a second output terminal; the first input terminal of the scanning signal selection circuit is electrically coupled with the gate drive circuit, the second input terminal access a low-potential signal, the first control terminal and the second control terminal respectively access a first control signal and a second control signal, the first output terminal and the second output terminal are both electrically coupled with the pixel drive circuit;

the gate drive circuit outputs a scanning signal to the first input terminal of the scanning signal selection circuit;

the scanning signal selection circuit controls the first output terminal and the second output terminal to simultaneously output the low-potential signal, or simultaneously output the scanning signal, or respectively output the low-potential signal and the scanning signal, or respectively output the scanning signal and the low-potential signal to the pixel drive circuit according to the first control signal and the second control signal.

2. The scanning drive system of AMOLED display panel according to claim 1, wherein when both of the first control signal and the second control signal are low-potential, the first output terminal and the second output terminal simultaneously output the low-potential signal to the pixel drive circuit;

when both of the first control signal and the second control signal are high-potential, the first output terminal and the second output terminal simultaneously output the scanning signal to the pixel drive circuit;

when the first control signal is low-potential and the second control signal is high-potential, the first output terminal and the second output terminal respectively output the low-potential signal and the scanning signal to the pixel drive circuit; and when the first control signal is high-potential and the second control signal is low-potential, the first output terminal and the second output terminal respectively output the scanning signal and the low-potential signal to the pixel drive circuit.

3. The scanning drive system of AMOLED display panel according to claim 1, wherein the scanning signal selection circuit comprises a first TFT, a second TFT, a third TFT, a fourth TFT, a first inverter and a second inverter;

a gate of the first TFT is electrically coupled with an output terminal of the first inverter, and a source of the first TFT access the low-potential signal, a drain of the first TFT is electrically coupled with a drain of the second TFT;

a gate of the second TFT is electrically coupled with an input terminal of the first inverter, and a source of the second TFT access the scanning signal;

a gate of the third TFT is electrically coupled with an input terminal of the second inverter, and a source of the third TFT is electrically coupled with a source of the second TFT, a drain of the third TFT is electrically coupled with a drain of the fourth TFT;

a gate of the fourth TFT is electrically coupled with an output terminal of the second inverter, and a source of the fourth TFT access the low-potential signal;

an input terminal of the first inverter and an input terminal of the second inverter are respectively access the first control signal and the second control signal.

4. The scanning drive system of AMOLED display panel according to claim 1, wherein the pixel drive circuit comprises a fifth TFT, a sixth TFT, a seventh TFT, a eighth TFT, a ninth TFT, a capacitance and an OLED;

a gate of the fifth TFT is electrically coupled with the first output terminal of the scanning signal selection circuit, and a source of the fifth TFT access a maintaining voltage, a drain of the fifth TFT is electrically coupled with a first terminal of the capacitance;

a gate of the sixth TFT is electrically coupled with the second output terminal of the scanning signal selection circuit, and a source of the sixth TFT access a data signal, a drain of the sixth TFT is electrically coupled with a first terminal of the capacitance;

a gate of the seventh TFT is electrically coupled with the second output terminal of the scanning signal selection circuit, and a source of the seventh TFT is electrically coupled with a source of the eighth TFT, a drain of the seventh TFT is electrically coupled with a gate of the ninth TFT;

a gate of the eighth TFT is electrically coupled with the first output terminal of the scanning signal selection circuit, and a drain of the eighth TFT access a power high voltage;

a drain of the ninth TFT is electrically coupled with the source of the eighth TFT, and a source of the ninth TFT is electrically coupled with an anode of the OLED;

a second terminal of the capacitance is electrically coupled with the gate of the ninth TFT; and a cathode terminal of the capacitance access a power negative voltage.

5. The scanning drive system of AMOLED display panel according to claim 4, wherein working processes of the pixel drive circuit sequentially comprises a data signal writing phase, a threshold voltage compensation phase and a light-emitting phase;

the first output terminal of the scanning signal selection circuit outputs the low-potential signal, and the second output terminal outputs the scanning signal in the data signal writing phase;

the first output terminal and the second output terminal of the scanning signal selection circuit both output the scanning signal in the threshold voltage compensation phase;

the first output terminal of the scanning signal selection circuit outputs the scanning signal, and the second output terminal outputs the low-potential signal in the light-emitting phase.

6. The scanning drive system of AMOLED display panel according to claim 1, wherein the AMOLED display panel comprises a display region and a non-display region surroundings to the display region, the pixel drive circuit is positioned in the display region, and the scanning signal selection circuit is positioned in the non-display region.

7. The scanning drive system of AMOLED display panel according to claim 6, wherein the gate drive circuit is a GOA circuit formed in the non-display region or an integrated circuit integrated circuit external to the non-display region.

8. The scanning drive system of AMOLED display panel according to claim 1, wherein the first control signal and the second control signal are both provided by an outside time schedule controller.

9. A scanning drive system of AMOLED display panel, comprising a gate drive circuit, a scanning signal selection circuit, and a pixel drive circuit;

the scanning signal selection circuit comprises a first input terminal, a second input terminal, a first control terminal, a second control terminal, a first output terminal and a second output terminal; the first input terminal of the scanning signal selection circuit is electrically coupled with the gate drive circuit, the second input terminal access a low-potential signal, the first control terminal and the second control terminal respectively access a first control signal and a second control signal, the first output terminal and the second output terminal are both electrically coupled with the pixel drive circuit;

the gate drive circuit outputs a scanning signal to the first input terminal of the scanning signal selection circuit;

the scanning signal selection circuit controls the first output terminal and the second output terminal to simultaneously output the low-potential signal, or simultaneously output the scanning signal, or respectively output the low-potential signal and the scanning signal, or respectively output the scanning signal and the low-potential signal to the pixel drive circuit according to the first control signal and the second control signal;

wherein when both of the first control signal and the second control signal are low-potential, the first output terminal and the second output terminal simultaneously output the low-potential signal to the pixel drive circuit;

when both of the first control signal and the second control signal are high-potential, the first output terminal and the second output terminal simultaneously output the scanning signal to the pixel drive circuit;

when the first control signal is low-potential and the second control signal is high-potential, the first output terminal and the second output terminal respectively output the low-potential signal and the scanning signal to the pixel drive circuit;

when the first control signal is high-potential and the second control signal is low-potential, the first output terminal and the second output terminal respectively output the scanning signal and the low-potential signal to the pixel drive circuit;

wherein the scanning signal selection circuit comprises a first TFT, a second TFT, a third TFT, a fourth TFT, a first inverter and a second inverter;

a gate of the first TFT is electrically coupled with an output terminal of the first inverter, and a source of the first TFT access the low-potential signal, a drain of the first TFT is electrically coupled with a drain of the second TFT;

a gate of the second TFT is electrically coupled with an input terminal of the first inverter, and a source of the second TFT access the scanning signal;

a gate of the third TFT is electrically coupled with an input terminal of the second inverter, and a source of the third TFT is electrically coupled with a source of the second TFT, a drain of the third TFT is electrically coupled with a drain of the fourth TFT;

a gate of the fourth TFT is electrically coupled with an output terminal of the second inverter, and a source of the fourth TFT access the low-potential signal;

an input terminal of the first inverter and an input terminal of the second inverter are respectively access the first control signal and the second control signal;

wherein the pixel drive circuit comprises a fifth TFT, a sixth TFT, a seventh TFT, a eighth TFT, a ninth TFT, a capacitance and an OLED;

a gate of the fifth TFT is electrically coupled with the first output terminal of the scanning signal selection circuit, and a source of the fifth TFT access a maintaining voltage, a drain of the fifth TFT is electrically coupled with a first terminal of the capacitance;

a gate of the sixth TFT is electrically coupled with the second output terminal of the scanning signal selection circuit, and a source of the sixth TFT access a data signal, a drain of the sixth TFT is electrically coupled with a first terminal of the capacitance;

a gate of the seventh TFT is electrically coupled with the second output terminal of the scanning signal selection circuit, and a source of the seventh TFT is electrically coupled with a source of the eighth TFT, a drain of the seventh TFT is electrically coupled with a gate of the ninth TFT;

a gate of the eighth TFT is electrically coupled with the first output terminal of the scanning signal selection circuit, and a drain of the eighth TFT access a power high voltage;

a drain of the ninth TFT is electrically coupled with the source of the eighth TFT, and a source of the ninth TFT is electrically coupled with an anode of the OLED;

a second terminal of the capacitance is electrically coupled with the gate of the ninth TFT;

a cathode terminal of the capacitance access a power negative voltage;

wherein working processes of the pixel drive circuit sequentially comprises a data signal writing phase, a threshold voltage compensation phase and a light-emitting phase;

the first output terminal of the scanning signal selection circuit outputs the low-potential signal, and the second output terminal outputs the scanning signal in the data signal writing phase;

the first output terminal and the second output terminal of the scanning signal selection circuit both output the scanning signal in the threshold voltage compensation phase;

the first output terminal of the scanning signal selection circuit outputs the scanning signal, and the second output terminal outputs the low-potential signal in the light-emitting phase.

10. The scanning drive system of AMOLED display panel according to claim 9, wherein the AMOLED display panel comprises a display region and a non-display region surroundings to the display region, the pixel drive circuit is positioned in the display region, and the scanning signal selection circuit is positioned in the non-display region.

11. The scanning drive system of AMOLED display panel according to claim 10, wherein the gate drive circuit is a GOA circuit formed in the non-display region or an integrated circuit integrated circuit external to the non-display region.

12. The scanning drive system of AMOLED display panel according to claim 9, wherein the first control signal and the second control signal are both provided by an outside time schedule controller.

* * * * *